US006857950B2

(12) United States Patent
Hayashi et al.

(10) Patent No.: US 6,857,950 B2
(45) Date of Patent: Feb. 22, 2005

(54) POLISHING APPARATUS, SEMICONDUCTOR DEVICE MANUFACTURING METHOD USING THE POLISHING APPARATUS, AND SEMICONDUCTOR DEVICE MANUFACTURED BY THE MANUFACTURING METHOD

(75) Inventors: Yutaka Hayashi, Yokohama (JP); Yutaka Uda, Tokyo (JP)

(73) Assignee: Nikon Corporation, Tokyo (JP)

( * ) Notice: Subject to any disclaimer, the term of this patent is extended or adjusted under 35 U.S.C. 154(b) by 317 days.

(21) Appl. No.: 09/862,323

(22) Filed: May 23, 2001

(65) Prior Publication Data

US 2002/0033230 A1 Mar. 21, 2002

(30) Foreign Application Priority Data

Sep. 21, 2000 (JP) ..... 2000-286435

(51) Int. Cl.[7] ..... B24B 41/06; B24D 9/10; B24D 11/00; H01L 21/302

(52) U.S. Cl. ..... 451/397; 451/398; 451/494; 438/692; 438/693; 51/110; 51/126

(58) Field of Search ..... 451/397, 398, 451/494; 438/692, 693; 51/110, 126

(56) References Cited

U.S. PATENT DOCUMENTS 3,762,105 A * 10/1973 Ross ..... 451/281
5,538,465 A * 7/1996 Netsu et al. ..... 451/397
5,730,642 A * 3/1998 Sandhu et al. ..... 451/6
5,906,532 A * 5/1999 Nakajima et al. ..... 451/41
5,993,302 A 11/1999 Chen et al.
6,165,056 A 12/2000 Hayashi et al. ..... 451/281
6,220,945 B1 4/2001 Hirokawa et al. ..... 451/287
6,299,511 B1 * 10/2001 Gurusamy et al. ..... 451/56
6,302,770 B1 * 10/2001 Aiyer ..... 451/56
6,354,928 B1 * 3/2002 Crevasse et al. ..... 451/397
6,371,836 B1 * 4/2002 Brown et al. ..... 451/56
6,398,906 B1 * 6/2002 Kobayashi et al. .... 156/345.12
6,407,000 B1 * 6/2002 Hudson ..... 438/693
6,432,257 B1 * 8/2002 Nagasaka et al. ..... 156/345.12
6,498,101 B1 * 12/2002 Wang ..... 438/691

FOREIGN PATENT DOCUMENTS

| | | |
|---|---|---|
| EP | 1 034 885 A2 | 9/2000 |
| EP | 1 034 885 A3 | 3/2001 |
| JP | 11-156711 | 6/1999 |
| JP | 2000-6004 | 1/2000 |

* cited by examiner

*Primary Examiner*—Long Pham
*Assistant Examiner*—Shrinivas H. Rao
(74) *Attorney, Agent, or Firm*—Morgan, Lewis & Bockius LLP

(57) ABSTRACT

The present invention provides a polishing apparatus with a construction which makes it possible to prevent the peripheral portions of a substrate from sloping downward as a result of the polishing member tilting at the peripheral portions of the substrate during the polishing of the substrate, and which makes it possible to adjust the contact pressure quickly in accordance with changes in the contact area between the polishing surface and the substrate surface.

39 Claims, 9 Drawing Sheets

POLISHING APPARATUS, SEMICONDUCTOR DEVICE MANUFACTURING METHOD USING THE POLISHING APPARATUS, AND SEMICONDUCTOR DEVICE MANUFACTURED BY THE MANUFACTURING METHOD

BACKGROUND OF THE INVENTION

1. Field of the Invention

The present invention relates to a polishing apparatus which polishes and smooths the surface of a substrate such as a wafer, etc., used in semiconductor devices, a semiconductor device manufacturing method using this apparatus, and a semiconductor device manufactured by this manufacturing method.

2. Description of the Related Art

In recent years, as IC's have become finer and more complex, and as the number of layers of multi-layer wiring has increased, the steps on IC surfaces have become increasingly larger, and the precision of polishing wafer surfaces that is performed following the formation of respective thin films has become more important. If the precision of polishing performed following such thin film formation is poor, there is a danger that local thinning of the thin films may occur in step areas, and that faulty wiring insulation or short-circuiting, etc., may occur. Furthermore, in lithographic processes, an out-of-focus state may result if there are numerous indentations and projections in the surface of the wafer, so that it may become impossible to form fine patterns.

Conventionally, a polishing apparatus polishes and smooths the surface of the wafer by causing the surface (undersurface) of the wafer held on the lower part of a spindle to contact a polishing pad bonded to the upper surface of a rotating table while a liquid-form slurry (polishing liquid) containing silica particles is supplied. Japanese Patent Application Kokai No. SHO 11-156711 discloses a polishing apparatus in which the wafer is held on the upper surface side of a rotating table so that the polished state of the wafer surface can be observed during polishing, a polishing member supported on a polishing head that is attached to a spindle is pressed against the wafer surface, and the wafer is polished by causing a polishing pad pasted to the undersurface of the polishing member to contact the wafer surface.

However, in such a polishing apparatus, the polishing surface (polishing pad) has smaller dimensions (a smaller diameter) than the substrate, such as a wafer, etc., that is being polished, and the apparatus is arranged so that the entire surface of the wafer can be polished by causing the polishing head to oscillate with respect to the wafer surface. As a result, in cases where the polishing surface protrudes beyond the outer circumference of the wafer during polishing, the polishing member is tilted, so that the peripheral portions of the wafer are caused to slope downward. Furthermore, the apparatus is arranged so that the contact pressure between the polishing member and the wafer surface is adjusted by means of air pressure that drives the polishing member downward inside the polishing head; however, since such control by means of air pressure has a slow response, the adjustment of the contact pressure cannot be caused to follow the variation in the contact area between the two parts that occurs when the polishing surface protrudes beyond the outer circumference of the wafer.

Accordingly, the polished state of the wafer surface tends not to be uniform.

SUMMARY OF THE INVENTION

Accordingly, the present invention is directed to a polishing apparatus to overcome the problems of the prior art.

The polishing apparatus of the present invention includes a rotating table for holding a substrate to be polished, a polishing member having a polishing surface which is pressed against a surface of the substrate, wherein the polishing member rotates about an axis substantially parallel to an axis of rotation the rotating table, and the polishing member oscillates in a direction parallel to the surface of the substrate to polish the substrate, an attitude-maintaining means for maintaining the polishing member in a fixed attitude with respect to the surface of the substrate by applying a corrective moment to the polishing member during polishing. Here, the term "corrective moment" refers to a moment that acts in a direction that cancels the tendency of the polishing member to tilt with respect to the substrate surface.

In the polishing apparatus of the present invention, a corrective moment is applied to the polishing member during the polishing of the substrate, so that the polishing member is maintained in a fixed attitude with respect to the surface of the substrate; accordingly, even in cases where the polishing surface protrudes beyond the outer circumference of the substrate, there is no tilting of the polishing member at the outer circumferential edge of the substrate, so that the peripheral portions of the substrate are not caused to slope downward (i.e., are not beveled). As a result, the rate of production of satisfactory substrates is increased, so that manufacturing costs can be reduced.

Here, if the attitude-maintaining means is arranged so that a corrective moment is applied to the polishing member in accordance with the position of the polishing member relative to the rotating table, then it is necessary merely to investigate the relationship between the position of the polishing member relative to the rotating table and the moment in the direction of inclination that may occur in the polishing member in this case beforehand, to store this data in memory, and to apply a corrective moment that cancels the above-mentioned moment to the polishing member in accordance with the position of the polishing member relative to the rotating table during polishing. Accordingly, the construction of the control system is simplified. Alternatively, it would also be possible to install a sensor that detects the distribution of the contact pressure between the polishing surface and the substrate surface or the inclination of the polishing surface relative to the substrate surface, and to arrange the apparatus so that a corrective moment is applied to the polishing member on the basis of the information detected by this sensor. In this case, the embodiment is more complicated; however, since the inclination of the polishing member can be prevented more securely, the polishing precision is greatly improved.

Here, it is desirable that the attitude-maintaining means be equipped with an electromagnetic actuator that generates an electromagnetic force corresponding to the current that is supplied, and that the apparatus be arranged so that a corrective moment is applied to the polishing member using the electromagnetic force generated by this electromagnetic actuator. Since such an electromagnetic actuator has a quick response, a great effect is obtained in cases where it is necessary to adjust the attitude of the polishing member quickly, as in the present apparatus.

Furthermore, it is especially desirable that the electromagnetic actuator be equipped with an annular permanent magnet which is supported on the outer circumferential part of the polishing member (e.g., on the protruding member 51 in the working configuration), and whose magnetic field is oriented in the direction of the radius of the polishing member, and a plurality of coils which are supported on a non-rotating member, which are disposed in the form of a circle that is substantially concentric with the permanent magnet, and which have parts that cross the magnetic field at right angles, and that the apparatus be arranged so that the electromagnetic actuator applies a corrective moment to the polishing member using the Lorenz force that is generated between the magnetic field and the current that flows through the horizontal portions of the coils that face the part of the polishing member that floats upward from the substrate surface or is pushed downward against this surface, as a result of the coils being electrified. If this is done, attitude correction of the polishing member can be accomplished with a good response using a simple construction.

Furthermore, it is desirable that the polishing member be pressed against the substrate by receiving the electromagnetic force generated by the electromagnetic actuator, and that the polishing member be arranged so that the contact pressure between the polishing surface and the substrate surface can be maintained at a constant value by adjusting the current that is supplied to the electromagnetic actuator. Alternatively, the polishing member may be pressed against the substrate by receiving air pressure and the electromagnetic force generated by the electromagnetic actuator, and the polishing member may be arranged so that the contact pressure between the polishing surface and the substrate surface can be maintained at a constant value by adjusting the air pressure and the current that is supplied to the electromagnetic actuator. If such an embodiment is used, the control that always maintains the contact pressure between the polishing surface and the substrate surface at a constant value can be performed with a better response (especially when the polishing surface protrudes beyond the outer circumference of the substrate so that the contact area between the two parts varies) than in a conventional construction in which the polishing member is pressed against the substrate by air pressure (alone); accordingly, the uniformity of the state of polishing on the substrate surface can be improved.

Alternatively, the polishing member may be pressed against the substrate by receiving the electromagnetic force generated by a shaft motor, and may be arranged so that the contact pressure between the polishing surface and the substrate surface can be adjusted by means of the current that is supplied to the shaft motor. The contact pressure between the polishing surface and the substrate surface can be quickly adjusted using such an embodiment as well.

Furthermore, an embodiment may be used in which the attitude-maintaining means is equipped with a plurality of cylinder type actuators which are fastened to a non-rotating member, and in which pistons that have rollers attached to their lower end portions move upward and downward inside cylinders that extend in the vertical direction, the plurality of cylinder type actuators are positioned so that they surround the periphery of the polishing member, the rollers contact the outer circumferential portion of the polishing member (e.g., the protruding member 151 in the working configuration) from above, and a corrective moment is applied to the polishing member as a result of the pistons of the cylinder type actuators positioned in areas where the polishing member tends to float upward from the substrate surface being lowered so that the polishing member is pushed downward. In this embodiment, when the polishing member is tilted, the cylinder type actuators that press against this polishing member are fastened to a non-rotating member, but the lower end portions of the pistons contact the outer circumferential portions of the polishing member via rollers that are free to roll; accordingly, there is no interference with the rotation of the polishing member. In this embodiment as well, there is no tilting of the polishing member at the outer circumferential portions of the substrate even if the polishing surface protrudes beyond the outer circumference of the substrate during the polishing of the substrate; accordingly, sloping (beveling) of the peripheral portions of the substrate can be prevented.

Furthermore, an embodiment may be used in which the attitude-maintaining means is equipped with a plurality of cylinder type actuators which are fastened to a non-rotating member, and in which pistons that have first permanent magnets attached to their lower end portions move upward and downward inside cylinders that extend in the vertical direction, an annular second permanent magnet which is installed so that it faces all of the first permanent magnets is disposed on the outer circumferential portion of the polishing member (e.g., the protruding member 251 in the working configuration), the plurality of cylinder type actuators are positioned so that they surround the periphery of the polishing member, the facing surfaces of the respective permanent magnets have the same polarity, and a corrective moment is applied to the polishing member as a result of the pistons of the cylinder type actuators positioned in areas where the polishing member tends to float upward from the substrate surface being lowered so that the polishing member is pushed downward. In this embodiment as well, when the polishing member is tilted, the cylinder type actuators that press against this polishing member are fastened to a non-rotating member, but the lower end portions of the pistons push the polishing member downward via magnets that repel each other; accordingly, there is no interference with the rotation of the polishing member. Consequently, an effect similar to that obtained in a case where rollers are used as described above can be obtained using this embodiment as well; in this case, however, since the system is a non-contact type system utilizing the repulsive force of magnets, the system is superior in terms of durability compared to a system using rollers, so that maintenance costs can be reduced.

Here, the above-mentioned cylinder type actuators may be operated by air pressure; however, in order to increase the response speed, it is desirable that these actuators be operated by an electromagnetic force.

Furthermore, the semiconductor device manufacturing method of the present invention has a process in which the surface of a substrate is polished using the polishing apparatus. As a result, the yield of semiconductor devices manufactured by this semiconductor device manufacturing method can be increased. Furthermore, the semiconductor device of the present invention is manufactured by the semiconductor device manufacturing method. Since substrates with a high degree of smoothness are used in the semiconductor devices manufactured by the manufacturing method, these devices show good performance, with few problems such as faulty insulation or short-circuiting, etc., of the wiring.

DETAILED DESCRIPTION OF THE PREFERRED EMBODIMENTS

Below, preferred working embodiments of the present invention will be described with reference to the attached figures.

Figure 1:
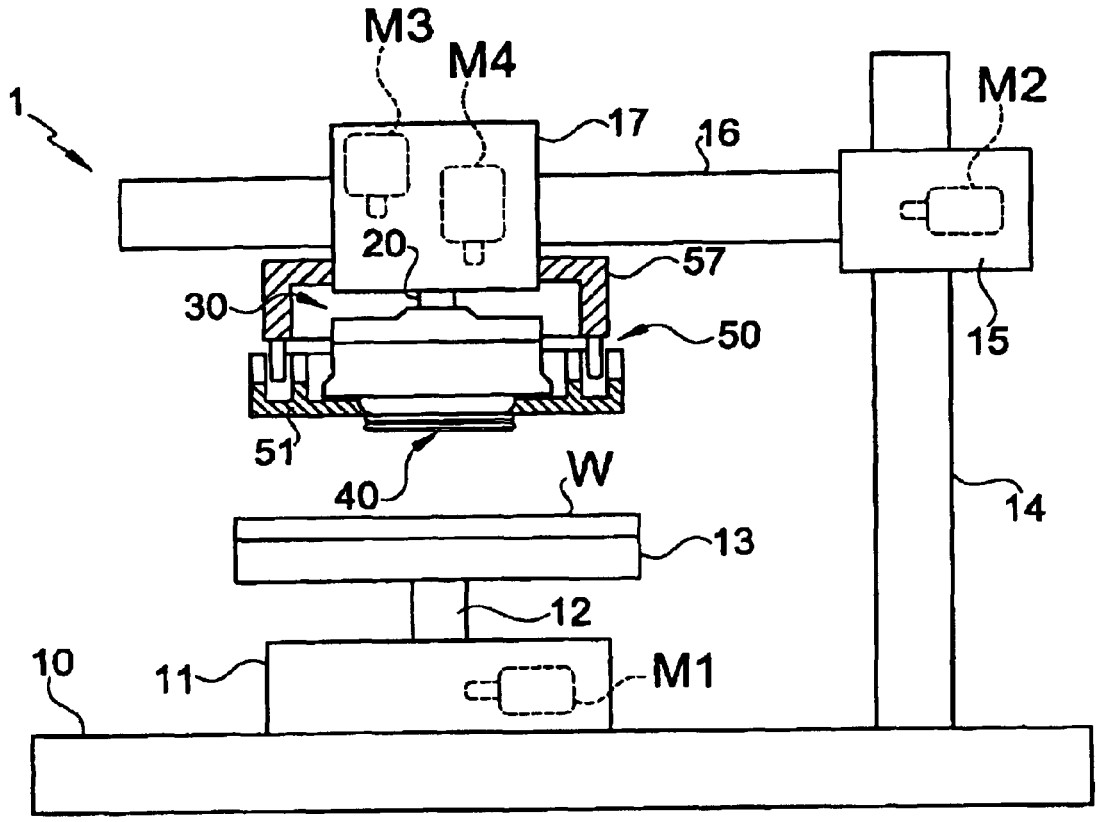
FIG. 1 is a partially sectional side view of a CMP apparatus using the polishing apparatus of the present invention.

FIG. 1 shows an embodiment in which the polishing apparatus of the present invention is applied to a CMP apparatus (chemical-mechanical polishing apparatus). In this CMP apparatus 1, a table supporting part 11 is installed on the upper surface of a base stand 10, and a shaft 12 is supported on this table supporting part 11 so that the shaft 12 extends vertically and is free to rotate. A rotating table 13 is installed in a horizontal attitude on the upper end of this shaft 12. A wafer W is held by vacuum suction on the upper surface side of the rotating table 13 as a substrate which constitutes the polished member. This rotating table 13 is caused to rotate in the horizontal plane by driving the shaft 12 by means of an electric motor M1 contained in the table supporting part 11.

A supporting column 14 is installed so that it extends vertically to one side of the table supporting part 11, and a first moving stage 15 to which a horizontal arm 16 is fastened is supported on this supporting column 14 so that the first moving stage 15 is free to move upward and downward. The horizontal arm 16 extends over the rotating table 13, and a second moving stage 17 which holds a spindle 20 in a vertical position is supported on this horizontal arm 16 so that the second moving stage 17 is free to move in the horizontal direction. The first moving stage 15 can be caused to move upward and downward along the supporting column 14 by the driving of an electric motor M2 contained in the first moving stage 15, and the second moving stage 17 can be caused to move in the horizontal direction along the horizontal arm 16 by the driving of an electric motor M3 contained in the second moving stage 17. Furthermore, the spindle 20 can be rotationally driven by an electric motor M4 contained in the second moving stage 17 (the axis of rotation of the spindle 20 is substantially parallel to the axis of rotation of the shaft 12).

A polishing head 30 is attached to the lower end portion of the spindle 20. As is shown in FIGS. 2 and 3, this polishing head 30 is constructed from a tension flange 31 which consists of a disk member 31*a* that is detachably attached to the spindle 20 and a cylindrical member 31*b* that is detachably attached to the undersurface side of the disk member 31*a* by means of bolts B1, a ring member 32 which is fastened to the lower end portion of the cylindrical member 31*b* by means of bolts B2, a disk-form drive ring 33 which is clamped between the cylindrical member 31*b* and ring member 32, and a polishing member 40 which is attached to the undersurface side of the drive ring 33.

The drive ring 33 consists of a metal drive plate 34 and a rubber diaphragm 35 which is laminated on the undersurface side of the drive plate 34. Circular holes 34*a* and 35*a* which have substantially the same radius are respectively formed in the central portions of the drive plate 34 and diaphragm 35. The outer circumferential portions of the drive plate 34 and diaphragm 35 are fastened in place by being clamped between the tension flange 31 and ring member 32 as described above. However, the drive plate 34 has an appropriate flexibility as a result of three types of concentric circular-arc-form through-holes 34*b*, 34*c* and 34*d* which are formed in the drive plate 34 itself at different distances from the center; accordingly, the drive plate 34 can show a slight out-of-plane deformation.

The polishing member 40 is constructed from a disk-form reference plate 41, a disk-form pad plate 42 which has substantially the same external diameter as the above-mentioned reference plate 41, and a circular polishing pad 43 which has a radius that is slightly smaller than that of the pad plate 42. A disk-form central member 44 which has a radius that is slightly smaller than that of the circular holes 34*a* and 35*a* of the driving ring 33 (i.e., of the drive plate 34 and diaphragm 35) is fastened to the upper surface side of the central portion of the reference plate 41 by means of bolt B3, and the drive ring 33, whose center is aligned with this central member 44, is clamped between the reference plate 41 and a ring member 45 which is fastened to the upper surface side of the reference plate 41 by means of bolt B4. Thus, the reference plate 41 is fastened to the tension flange 31 via the drive ring 33 so that the rotation of the spindle 20 is transmitted to the reference plate 41. Furthermore, the external diameter of a flange 41*a* that protrudes outward from the outer circumferential portion of the reference plate 41 is made larger than the internal diameter of a flange 32*a* that protrudes inward from the inner circumferential portion of the ring member 32, so that the reference plate 41 does not slip out of the ring member 32.

Figure 2:
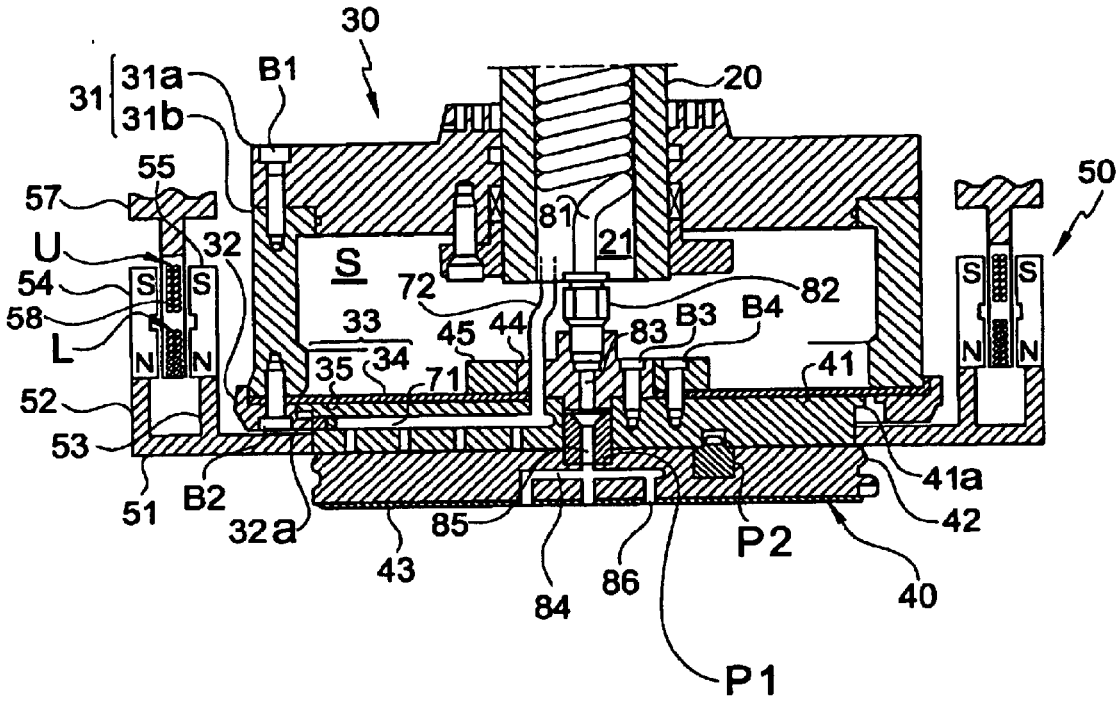
FIG. 2 is an enlarge sectional view of the peripheral portion of the polishing head in the CMP apparatus of the present invention.
Figure 3:
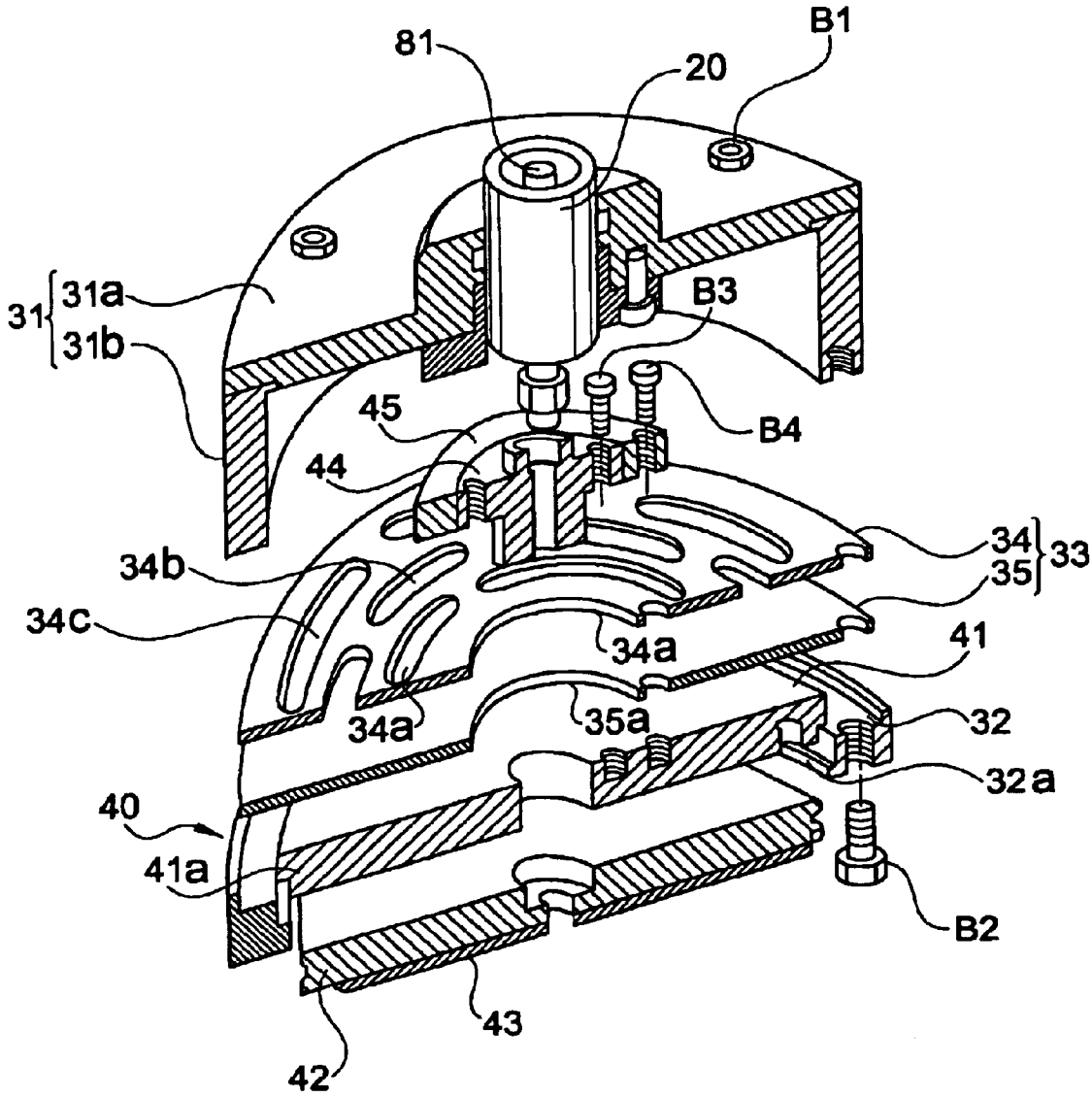
FIG. 3 is an exploded perspective view of the polishing head of the present invention.

As is shown in FIG. 2, an air intake passage 71 which extends in the planar direction and which has a plurality of suction attachment openings in the undersurface side is formed inside the reference plate 41. This air intake passage 71 also extends toward the central member 44, and opens inside the internal space S of the tension flange 31; however, an intake tube 72 which extends through an air supply passage 21 formed as a through-hole in the center of the spindle 20 is connected to this opening, and the apparatus is arranged so that in a state in which the pad plate 42 is positioned on the undersurface side of the reference plate 41, the pad plate 42 is attached to the reference plate 41 by vacuum suction as a result of air being sucked in via the above-mentioned intake tube 72. Here, the pad plate 42 is centered and positioned in the rotational direction by a center pin P1 and a positioning pin P2 that are installed between the pad plate 42 and the reference plate 41. Since the polishing pad 43 is a consumable part that gradually deteriorates as a result of polishing, this polishing pad 43 is detachably attached to the undersurface of the pad plate 42 (e.g., by means of an adhesive agent), so that replacement work is facilitated.

Furthermore, as is shown in FIGS. 1 and 2, this CMP apparatus 1 is equipped with an attitude-maintaining means 50 which maintains the polishing member 40 in a fixed attitude with respect to the surface of the wafer W (constituting the substrate) by applying a corrective moment to the polishing member during the polishing of the wafer W. This attitude-maintaining means 50 is constructed from a disk-form protruding member 51 which is detachably attached to the outer circumferential portion of the reference plate 41 by being engaged with this outer circumferential portion, annular permanent magnets 54 and 55 which are installed in magnet holding frames 52 and 53 consisting of two concentric cylindrical parts that protrude to the outside of the tension flange 31 and extend upward from the outer edge portion of the protruding member 51, as is shown in FIG. 1, a cylindrical coil holding frame 57 which protrudes outward and extends downward from the second moving stage 17 and whose lower end portion is positioned between the permanent magnets 54 and 55, and four coils 58 (see FIG. 4) that are wound around this coil holding frame 57.

Here, the permanent magnets 54 and 55 are respectively polarized above and below, and different poles face each other above and below (in the permanent magnet 54 located on the outside, the upper side is the S pole and the lower side is the N pole, while in the permanent magnet 55 located on the inside, the upper side is the N pole and the lower side is the S pole). Accordingly, a state results in which two magnetic fields of different orientations are generated in the radial direction of the polishing member 40 in the upper and lower parts of the permanent magnets 54 and 55.

Figure 4:
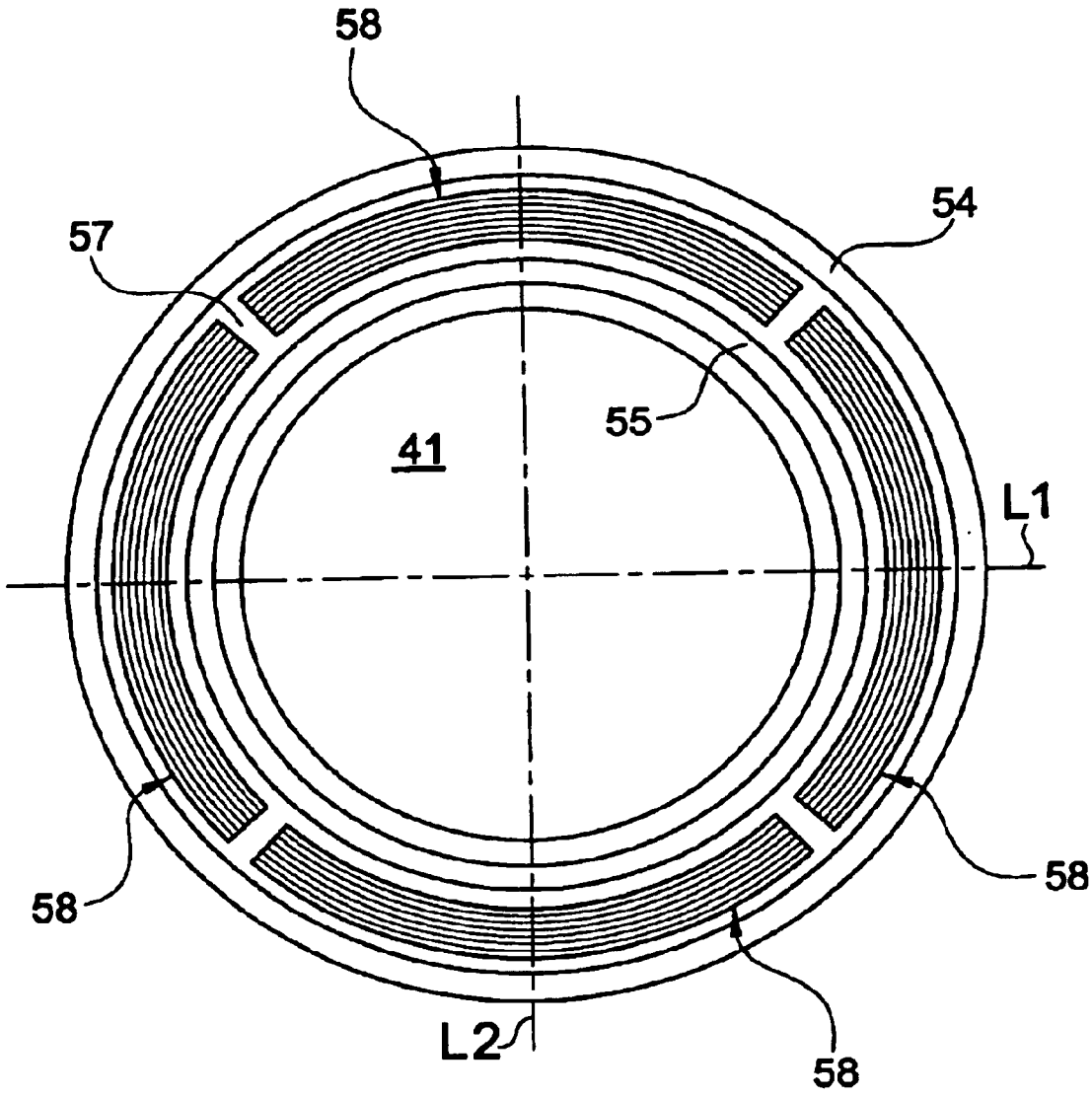
FIG. 4 is a plan view which illustrates the positional relationship between the permanent magnet and the coils in the electromagnetic actuator of the present invention.

The four coils 58 wound around the coil holding frame 57 have the same shape, and are attached so that these coils show rotational symmetry about the axis of rotation of the spindle 20. Accordingly, as is shown in FIG. 4, the two straight lines L1 and L2 obtained by connecting the centers of facing pairs of the four coils 58 cross each other at right angles; here, one of these two straight lines L1 and L2 coincides with the direction of oscillation of the polishing head 30 (in the present working configuration, the straight line L1 coincides with the direction of oscillation). Furthermore, the four coils 58 are wound around the coil holding frame 57 so that the circular-arc-form portions of the coils that are centered on the axis of rotation of the spindle 20 are horizontal portions, and the vertical portions of the coils 58 extend upward and downward along the vertical walls of the coil holding frame 57. Accordingly, the horizontal portions of the respective coils 58 form two rows (upper and lower, shown as U and L in FIG. 2); both of these horizontal portions U and L are positioned so that they respectively cut at right angles across the two magnetic fields formed in the upper and lower areas between the above-mentioned permanent magnets 54 and 55 (see FIGS. 2 and 4).

The four coils 58 held on the coil holding frame 57 can be individually electrified in the forward and reverse directions by a control device (not shown in the figures). When the reference plate 41 rotates, the permanent magnets 54 and 55 also rotate together with this reference plate 41. Since the permanent magnets 54 and 55 have an annular shape as described above, the magnetic fields acting between the magnets 54 and 55 (both magnetic fields with different orientations) are the same as when the reference plate 41 is stopped; however, when a current is caused to flow through these coils 58 in this state, the current flowing through the horizontal portions of the coils 58 crosses the above-mentioned magnetic fields at right angles, so that a Lorenz force that crosses both the current and the magnetic fields at right angles acts between the respective parts.

This Lorenz force is a force that causes the coils 58 to move in the vertical direction. Here, since the coils 58 are held on the coil holding frame 57 and fastened to the second moving stage 17, the permanent magnets 54 and 55, i.e., the reference plate 41, is caused to move in the vertical direction as a reaction (whether the portions of the reference plate 41 facing the coils 58 through which current is flowing move upward or downward depends on the direction of the current flowing through the coils 58). Here, in a case where a current oriented in the same direction is caused to flow through all of the four coils 58, a force that causes the reference plate 41 as a whole to move upward or downward is generated, and in a case where a current is caused to flow through one of the four coils 58, or a case where currents oriented in opposite directions are caused to flow through two opposite coils 58, a force that tilts the reference plate 41 is generated. Here, furthermore, since the number of coils 58 held on the coil holding frame 57 is four, the direction in which the polishing member 40 is tilted is one of four directions that are separated by 90 degrees.

In order to attach the polishing head 30 to the spindle 20, the disk-form member 31*a* alone of the tension flange 31 is first attached to the spindle 20, and the ring member 45 is attached to the reference plate 41 by means of the bolt B3 in a state in which the drive ring 33 is carried on the upper surface side of the reference plate 41 to which the central member 44 has been attached. Next, the ring member 32 is attached to the cylindrical member 31*b* by means of the bolt B2 in a state in which the drive ring 33 to which the above-mentioned reference plate 41 has been attached is positioned on the lower end portion of the cylindrical member 31*b*. Then, the bolts B1 are tightened in a state in which the cylindrical member 31*b* to which the reference plate 41 has thus been attached is positioned on the undersurface side of the disk-form member 31*a*, so that the cylindrical member 31*b* is attached to the disk-form member 31*a* (as a result, the tension flange 31 is assembled). Then, the pad plate 42 to which the polishing pad 43 has been pasted is attached by vacuum suction to the undersurface side of the reference plate 41, after which the magnet holding frame 51 of the attitude-maintaining means 50 is attached to the outer circumferential portion of the reference plate 41 so that the lower end portion of the coil holding frame 57, i.e., the four coils 58, are positioned between the magnets 54 and 55. When wafer polishing is to be performed in a state in which the polishing head 30 has thus been attached to the spindle 20, the wafer W that is the object of polishing is first held by vacuum suction on the upper surface of the rotating table 13, and the electric motor M1 is driven so that the rotating table 13 is caused to rotate. Here, the wafer W is attached to the rotating table 13 so that the center of the wafer W coincides with the center of the rotating table 13. Next, the electric motor M3 is driven so that the second stage 17 is positioned above the wafer W, and the spindle 20 is driven by the electric motor M4 so that the polishing head 30 is caused to rotate. Next, the electric motor M2 is driven so that the polishing head 30 is lowered and the polishing pad 43 is pressed against the surface of the wafer from above, and the electric motor M3 is driven so that the polishing head 30 is caused to oscillated in the direction parallel to the surface of the wafer.

Here, the air supply passage 21 that is formed inside the spindle 20 as shown in FIG. 2 is connected to an air feeding line (not shown in the figures); air is fed from here so that the pressure inside the internal space S of the tension flange 31 is increased, thus making it possible to drive the entire polishing member 40 downward inside the tension flange 31. Furthermore, the contact pressure between the polishing pad 43 and the surface of the wafer can be adjusted as desired by increasing or decreasing the air pressure inside the above-mentioned internal space S.

Furthermore, a polishing agent supply tube 81 which extends in helical form through the air supply passage 21 and opens into the interior of the internal space S of the tension flange 31 communicates with a supply passage 83 that is formed through the central member 44, a flow passage 84 that passes through the center pin P1, a flow passage 85 that is formed inside the pad plate 42 and flow passages 86 that are formed in the polishing pad 43, via a connection fitting 82 that is installed between the spindle 20 and the central member 44, and [the apparatus] is arranged so that a liquid-form slurry (polishing liquid) containing silica particles that is supplied from a polishing agent supply device (not shown in the figures) can be supplied to the undersurface side of the polishing pad 43.

Thus, the surface of the wafer W is uniformly polished and smoothed as a result of the rotational motion of the wafer W itself and the rotation and oscillation motion of the polishing head 30 (i.e., of the polishing pad 43) while the above-mentioned polishing agent is supplied. Since the reference plate 41 is attached to the tension flange 31 via the flexible drive ring 33 as was mentioned above, a slight out-of-plane deformation is possible, so that even in cases where the degree of parallel orientation of the polishing surface (i.e., the polishing pad 43) and the surface of the wafer is insufficient prior to the initiation of polishing as a result of apparatus assembly error, etc., this discrepancy can be absorbed during polishing.

Here, in cases where the polishing head 30 is caused to oscillate so that the polishing surface protrudes beyond the outer circumference of the wafer W, the polishing member 40 tilts with the outer circumferential edge of the wafer W as a supporting point. If no means is adopted in order to counter this, then polishing will be performed with the polishing member 40 in a tilted state, so that the peripheral portions of the wafer 40 slope downward (i.e., are beveled). In the present CMP apparatus 1, however, the polishing member 40 can be maintained in a fixed attitude with respect to the surface of the wafer as a result of a corrective moment being applied to the polishing member 40 by the above-mentioned attitude-maintaining means 50. Accordingly, the sloping (beveling) of the circumferential surface portions of the wafer W can be prevented.

Here, the attitude-maintaining means 50 applies a corrective moment to the polishing member 40 in accordance with the position of the polishing member 40 relative to the rotating table 13. Specifically, the relationship between the position of the polishing member 40 relative to the rotating table 13 and the tilting moment that can be generated in the polishing member 40 in the case of this position is investigated beforehand, and data concerning this relationship is stored in memory; then, during polishing, a corrective moment that cancels the above-mentioned tilting moment is applied to the polishing member 40 in accordance with the position of the polishing member 40 relative to the rotating table 13. Such an embodiment offers the advantage of a simple control system; however, in order to prevent tilting of the polishing member even more securely, it is desirable to install a sensor (not shown in the figures) that detects the distribution of the contact pressure between the polishing surface (polishing pad 43) and the surface of the wafer or the inclination of the polishing surface relative to the surface of the wafer, and to arrange the apparatus so that a corrective moment is applied to the polishing member 40 on the basis of detection information from this sensor. Although such an embodiment is more complicated, the polishing precision is greatly improved.

In such cases, the correction of the attitude of the polishing member 40 may be accomplished in concrete terms by applying current to the coils 58 positioned in areas where the polishing surface (polishing pad 43) tends to float upward from the surface of the wafer, with this current being applied in a direction that causes an upward-directed Lorenz force to act on these coils 58. As a result, the portions of the annular permanent magnets 54 and 55 that clamp these coils 58 receive a reaction force from the Lorenz force that acts on the coils 58, and this reaction force acts as a corrective moment so that the original attitude of the polishing member 40 is maintained (or so that the attitude is restored to the original attitude if the polishing member 40 has already been tilted). Alternatively, it would also be possible to apply current in the above-mentioned direction to the coils 58 positioned in areas where the polishing surface tends to float upward from the surface of the wafer, and to apply current in the opposite direction to the coils 58 located in positions that are opposite from the above-mentioned coils 58. In such a case, the portions of the permanent magnets 54 and 55 that clamp both sets of coils 58, 58 receive a reaction force from the Lorenz force that acts on these coils 58, 58, and this reaction force acts as a corrective moment so that the original attitude of the polishing member 40 is maintained (or so that the attitude is restored to the original attitude if the polishing member 40 has already been tilted). Furthermore, in this latter case, the respective Lorenz forces acting on the opposite coils 58, 58 are oriented in opposite directions; accordingly, the respective reaction forces acting on the permanent magnets 54 and 55 are also oriented in opposite directions, so that the corrective moment is an even force. Furthermore, it would also be possible to generate a corrective moment by applying current to coils 58 positioned in areas where the polishing surface is pushed downward instead of areas where the polishing surface floats upward from the surface of the wafer.

Furthermore, in cases where the polishing surface protrudes beyond the outer circumference of the wafer W so that the contact area is reduced, the pressing force of the polishing member 40 against the wafer W is reduced, thus adjusting the contact pressure between the polishing surface and the surface of the wafer so that this contact pressure is always maintained at a constant value. As was described above, the adjustment of the contact pressure between the polishing surface (i.e., the polishing pad 43) and the surface of the wafer in this case (i.e., the adjustment of the pressing force of the polishing member 40 against the wafer W) is accomplished by adjusting the pressure of the air that is supplied to the interior of the internal space S of the tension flange 31 from the air supply passage 21. In cases where an electromagnetic actuator of the above-mentioned configuration is used in the attitude-maintaining means 50 as in the present CMP apparatus 1, a force which pushes the polishing member 40 as a whole downward can be generated by causing currents of the same direction and magnitude to flow through all four of the coils 58. Accordingly, it is also possible to [use a construction in which] the polishing member 40 is pressed against the wafer W by means of such an electromagnetic actuator instead of (or together with) the above-mentioned construction in which the polishing member 40 is presses against the wafer W by means of air pressure.

Specifically, in a case where the polishing member 40 is pressed against the wafer W as a result of receiving the electromagnetic force generated by the electromagnetic actuator, the contact pressure between the polishing surface and the surface of the wafer is maintained at a constant value by adjusting the current that is supplied to the electromagnetic actuator, and in a case where the polishing member 40 is pressed against the wafer W as a result of receiving air pressure and the electromagnetic force generated by the electromagnetic actuator, the contact pressure between the polishing surface and the surface of the wafer is maintained at a constant value by adjusting the air pressure and the current that is supplied to the electromagnetic actuator.

In the case of such an embodiment, the control that always maintains the contact pressure between the polishing surface and the surface of the wafer at a constant value can be accomplished with a better response than in the case of a conventional construction in which the polishing member 40 is pressed against the wafer W by means of air pressure (alone); accordingly, the uniformity of the polishing on the surface of the wafer can be increased. Furthermore, in the case of an embodiment in which the polishing member 40 is pressed by means of both the air pressure and the electromagnetic actuator, it is desirable to arrange the apparatus so that the main component (low-frequency component) of the pressing force is adjusted by means of the slow-response air pressure, while the fluctuating component (high-frequency component) of the pressing force is adjusted by means of the quick-response electromagnetic actuator. If this is done, control of the contact pressure can be accomplished with good efficiency.

Furthermore, although not shown in the figures, an embodiment in which the polishing member 40 is attached to the lower end portion of the movable shaft of a shaft motor that is installed coaxially with the spindle 20, and a downward driving force is applied by means of the electromagnetic force generated by this shaft motor, may also be used. In such an embodiment as well, the contact pressure between the polishing surface and the surface of the wafer can be quickly adjusted by adjusting the current that is supplied to the shaft motor. Furthermore, the term "shaft motor" refers to an electromagnetic actuator which has a movable shaft (movable core) installed inside a coil, and which is constructed so that the movable shaft can be moved in the axial direction by a large force that corresponds to the current applied to the coil.

Figure 5A:
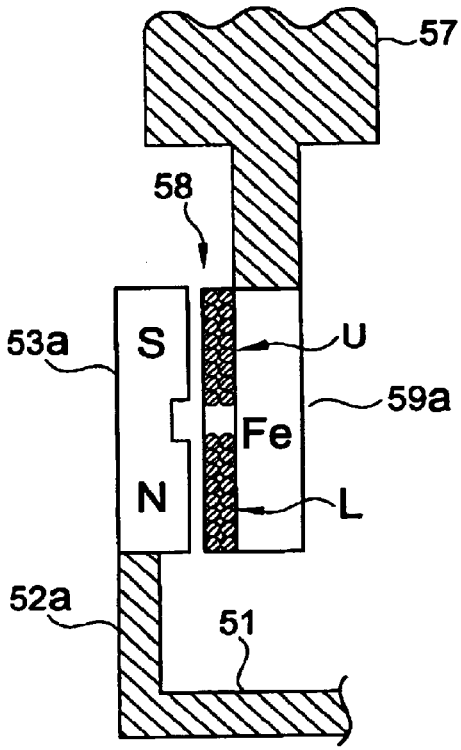
FIGS. 5(*a*) and 5(*b*) show partially sectional side views that illustrate modifications of combinations of permanent magnets and coils in the electromagnetic actuator of the present invention.

FIG. 5 shows modifications of the combination of permanent magnets and coils in the electromagnetic actuator shown in FIG. 2. In FIG. 5(A), the magnet holding frame that extends upward from the protruding member 51 is formed as a single frame (magnet holding frame 52*a*), and an annular permanent magnet 53*a* which is polarized above and below (S pole on the upper side and N pole on the lower side) is installed in this magnet holding frame 52*a*. Meanwhile, an annular iron element 59*a* is installed on the lower end portion of the coil holding frame 57 in a position facing the permanent magnet 53*a*, and the above-mentioned four coils 58 are installed on this iron element 59*a* in positions facing the permanent magnet 53*a* (as in the electromagnetic actuator shown in FIG. 2).

When an iron element 59*a* which faces the permanent magnet 53*a* polarized above and below is thus installed, this iron element 59*a* is magnetized by the permanent magnet 53*a* and is polarized above and below (N pole on the upper side and S pole on the lower side), so that two magnetic fields with different orientations are generated in the radial direction of the polishing member 40 in the upper and lower areas between the permanent magnet 53*a* and iron element 59*a*. The horizontal portions of the respective coils 58 form two rows (upper and lower, labeled as U and L); both of these horizontal portions U and L are positioned so that they cut at right angles across the two magnetic fields generated in the upper and lower areas between the above-mentioned permanent magnet 53*a* and iron element 59*a*.

Figure 5B:
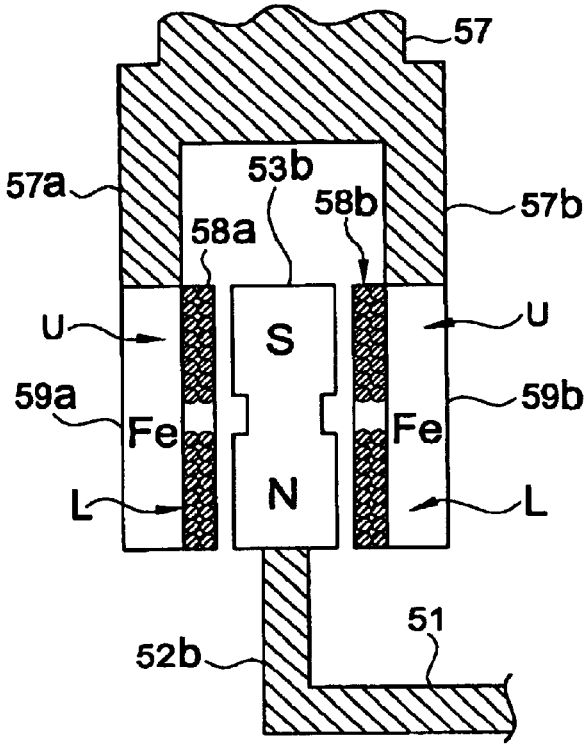

Furthermore, in FIG. 5(B), the magnet holding frame that extends upward from the protruding member 51 is similarly formed as a single frame (magnet holding frame 52*b*), and an annular permanent magnet 53*b* which is polarized above and below (S pole on the upper side and N pole on the lower side) is installed in this magnet holding frame 52*b*. Meanwhile, two concentric cylindrical parts 57*a* and 57*b* are formed on the lower end portion of the coil holding frame 57, and annular iron elements 59*a* and 59*b* are installed on the lower end portions of these cylindrical parts 57*a* and 57*b* in positions facing the permanent magnet 53*b*. Four coils 58*a* and 58*b* are respective installed in positions facing these iron elements 59*a* and 59*b* and the permanent magnet 53*b* (as in the electromagnetic actuator shown in FIG. 2).

When iron elements 59*a* and 59*b* which face the permanent magnet 53*b* polarized above and below are thus installed, these iron elements 59*a* and 59*b* are magnetized by the permanent magnet 53*b* and polarized above and below (N pole on the upper side and S pole on the lower side in both iron elements 59*a* and 59*b*), so that two magnetic fields with different orientations are generated in the radial direction of the polishing member 40 in the upper and lower areas between the permanent magnet 53*a* and iron elements 59*a* and 59*b*. The horizontal portions of the respective coils 58*a* and 58*b* form two rows (upper and lower, labeled as U and L); both of these horizontal portions U and L are positioned so that they cut at right angles across the two magnetic fields generated in the upper and lower areas between the above-mentioned permanent magnet 53*a* and iron elements 59*a* and 59*b*. In the modifications shown in FIGS. 5(A) and 5(B) as well, an operation similar to that of the above-mentioned electromagnetic actuator (i.e., the electromagnetic actuator shown in FIG. 2) is performed.

Figure 6:
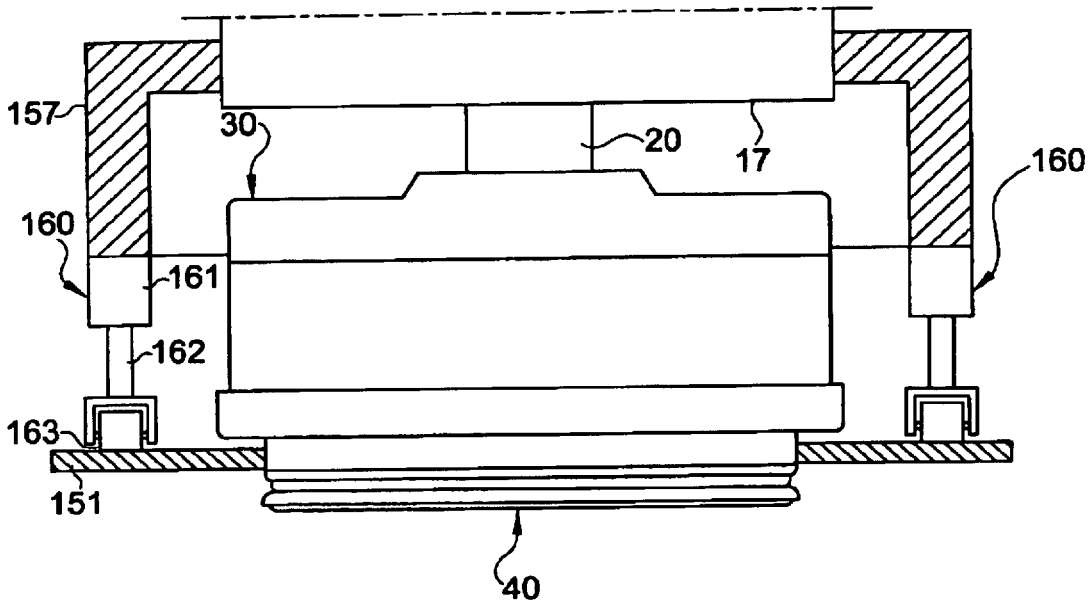
FIG. 6 is a partially sectional side view of the peripheral portion of the polishing head of a preferred embodiment of the electromagnetic actuator in the CMP apparatus of the present invention.

FIG. 6 shows a first modification of the electromagnetic actuator used in the present CMP apparatus 1. In the embodiment shown here, among the parts of the above-mentioned CMP apparatus 1, the coil holding frame 57 fastened to the second moving stage 17 is replaced by a cylindrical actuator holding frame 157 which is similarly disposed, and the magnet holding frame 51 attached to the reference plate 41 is replaced by a disk-form protruding member 151 (the above-mentioned actuator holding frame 157 and protruding member 151 are shown in cross section [in FIG. 6]); furthermore, a plurality of cylinder type actuators 160 are attached to the actuator holding frame 157, which is a non-rotating member. The respective cylinders 161 of these cylinder type actuators 160 are fastened to the actuator holding frame 157 and extend in the vertical direction; furthermore, a roller 163 is attached so that this roller is free to roll to the lower end portion of a piston 162 which can move upward and downward inside each of these cylinders 161. Furthermore, these cylinder type actuators 160 are positioned so that they surround the periphery of the polishing member 40, and the respective rollers 163 contact the protruding member 151 (that protrudes from the polishing member 40) from above.

In such an embodiment, the apparatus is arranged so that in cases where the polishing surface (i.e., the polishing pad 43) protrudes beyond the outer circumference of the wafer W and tilts during the polishing of the wafer W, the pistons 162 of the cylinder type actuators 160 positioned in areas where the polishing member 40 tends to float upward from the surface of the wafer are lowered so that the protruding member 151 (i.e., the polishing member 40) is pushed downward, thus applying a corrective moment to the polishing member 40. Accordingly, the respective cylinder type actuators 160 are installed in positions that make it possible to apply a downward-pressing force to portions where there is a possibility that the polishing member 40 will float upward from the surface of the wafer when the polishing member 40 tilts (for example, positions on the straight line L1 in FIG. 4).

Here, the cylinder type actuators 160 may be formed as air pressure cylinders in which the pistons 162 are caused to move upward or downward by the supply of air pressure to the interiors of the cylinders 161; however, in order to improve the response, electromagnetic actuators in which magnets and coils are combined inside the cylinders 161 and the pistons are caused by move upward and downward by means of an electromagnetic force may also be used.

Figure 7:
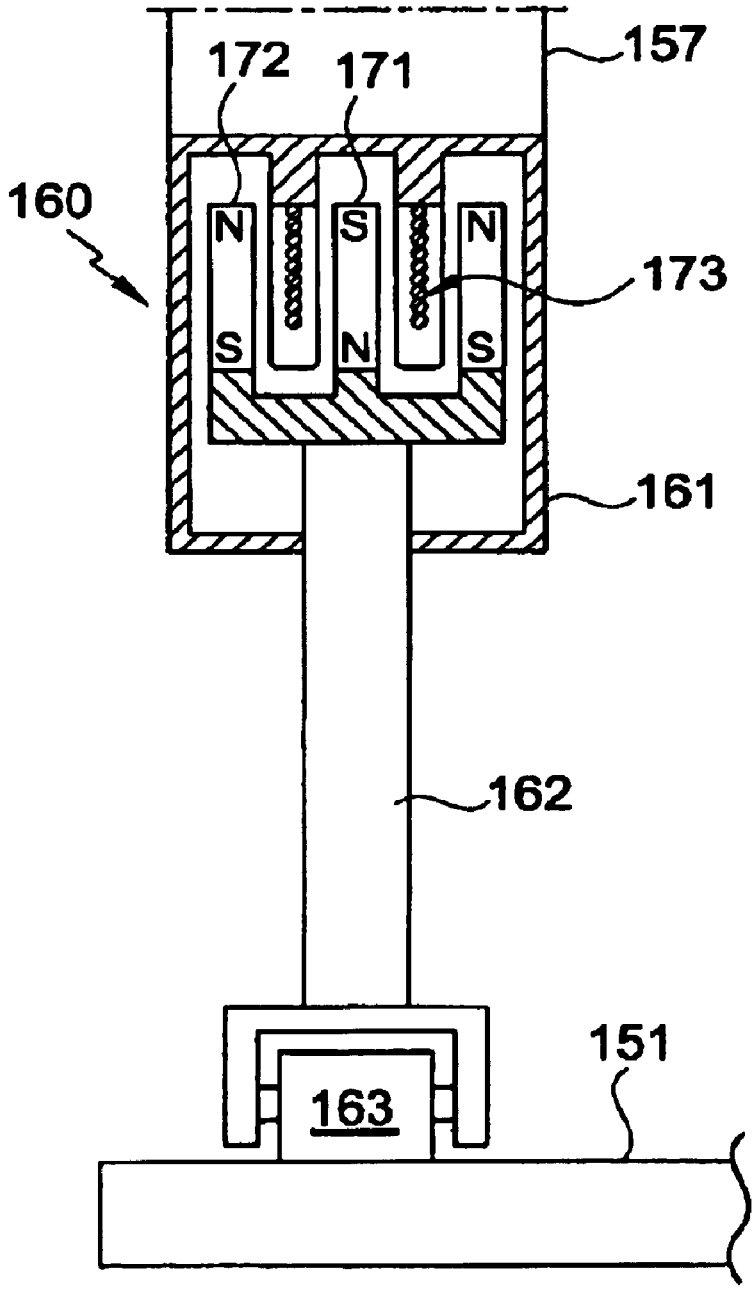
FIG. 7 is a partially sectional side view which illustrates cylinder type actuators used as electromagnetic actuators in the preferred embodiment.

FIG. 7 shows an embodiment in which the cylinder type actuators 160 are formed as electromagnetic actuators by combining magnets and coils inside the cylinders 161. In the embodiment shown here, a columnar magnet 171 which extends in the vertical direction and a tubular magnet 172 which extends in the vertical direction so that it surrounds the central [columnar] magnet [171] are installed in the center of the upper end portion of [each] piston 162, and these magnets 171 and 172 are polarized above and below so that the poles that face each other are unlike poles (S pole on the upper side and N pole on the lower side in the case of the columnar magnet, and N pole on the upper side and S pole on the lower side in the case of the tubular magnet). Meanwhile, a coil 173 is installed in [each] cylinder 161 so that this coil is positioned outside the columnar magnet 171 and inside the tubular magnet 172. Accordingly, when a current is caused to flow through the coil 173, the direction of this current and the direction of the magnetic flux that acts between the two magnets 171 and 172 are oriented at right angles to each other, and a Lorenz force that is oriented in the vertical direction acts on the coil 173. Since the coil 173 is fastened to the actuator holding frame 157, the resulting reaction force caused to piston 162 to move upward or downward.

In this embodiment, when the polishing member 40 tilts, the cylinder type actuators 160 that push the polishing member 40 are fastened to the actuator holding frame 157, which is a non-rotating member; however, since the lower end portions of the pistons 162 contact the outer circumferential portion (protruding member 151) of the polishing member 40 via rollers 163 that are free to roll, there is no interference with the rotation of the polishing member 40. In such an embodiment as well, tilting of the polishing member 40 at the outer circumferential edge of the wafer W can be suppressed in cases where the polishing surface (i.e., the polishing pad 43) protrudes beyond the outer circumference of the wafer W during the polishing of the wafer W, so that the polishing member 40 can be maintained in a fixed attitude with respect to the surface of the wafer; accordingly, sloping (beveling) of the peripheral portions of the wafer can be prevented.

Figure 8:
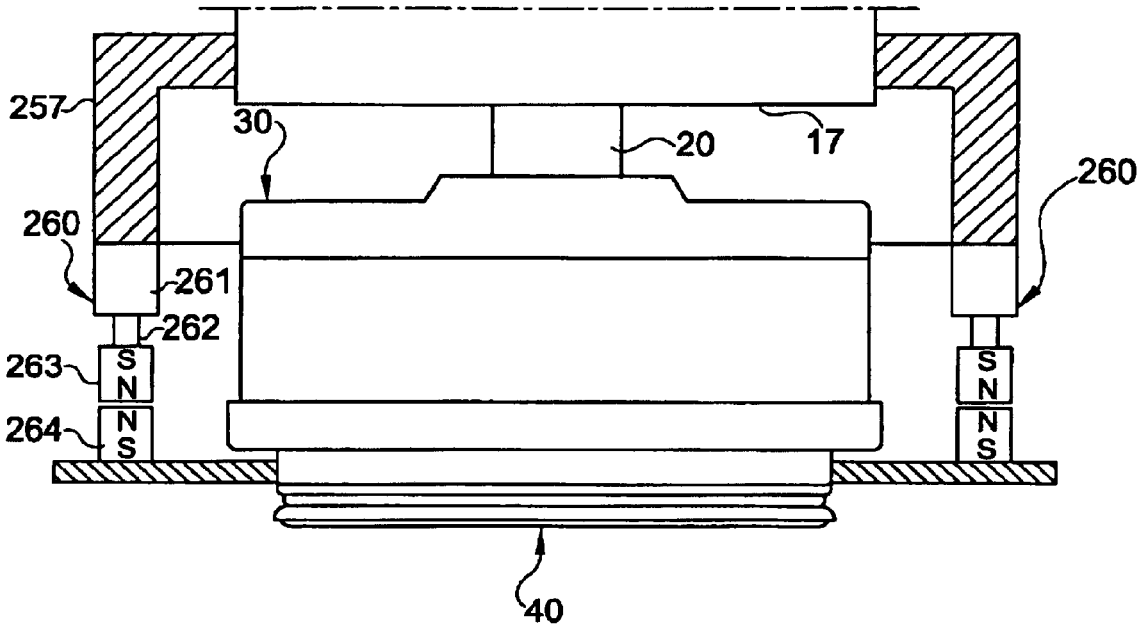
FIG. 8 is a partially sectional side view of the peripheral portion of the polishing head of a second embodiment of the electromagnetic actuator in the CMP apparatus of the present invention.

FIG. 8 shows a second embodiment of the electromagnetic actuator used in the present CMP apparatus 1. In the embodiment shown here, among the parts of the above-mentioned CMP apparatus 1, the coil holding frame 57 fastened to the second moving stage 17 is replaced by a cylindrical actuator holding frame 257 which is similarly disposed, and the magnet holding frame 51 attached to the reference plate 41 is replaced by a disk-form protruding member 251 (the actuator holding frame 257 and protruding member 251 are shown in cross section in FIG. 8); furthermore, a plurality of cylinder type actuators 260 are attached to the actuator holding frame 257, which is a non-rotating member. The respective cylinders 261 of these cylinder type actuators 260 are fastened to the actuator holding frame 257 and extend in the vertical direction; furthermore, a permanent magnet 263 is installed on the lower end portion of a piston 262 which can move upward and downward inside each of these cylinders 261. Furthermore, an annular permanent magnet 264 is installed on a disk-form protruding member 251 attached to the outer circumferential portion of the polishing member 40 so that this annular permanent magnet 264 faces all of the permanent magnets 263 attached to the respective cylinder type actuators 260. Furthermore, the cylinder type actuators 260 are positioned so that they surround the periphery of the polishing member 40, and are installed so that the poles of the permanent magnets 263 and 264 that face each other are like poles (N poles in this case).

In such an embodiment, the apparatus is arranged so that when the polishing surface (i.e., the polishing pad 43) protrudes beyond the outer circumference of the wafer W and tends to tilt during the polishing of the wafer W, the pistons 262 of the cylinder type actuators 260 positioned in areas where the polishing member 40 tends to float upward from the surface of the wafer are lowered so that the polishing member 40 (i.e., the protruding member 251) is pushed downward, thus applying a corrective moment to the polishing member 40. Accordingly, the respective cylinder type actuators 260 are installed in positions that make it possible to apply a downward-pressing force to portions where there is a possibility that the polishing member 40 will float upward from the surface of the wafer when the polishing member 40 tilts.

In this embodiment as well, when the polishing member 40 tilts, the cylinder type actuators 260 that push the polishing member 40 are fastened to the actuator holding frame 257, which is a non-rotating member; however, since the lower end portions of the pistons 262 push the polishing member 40 downward via magnets 263 and 264 that repeal each other, there is no interference with the rotation of the polishing member 40. Accordingly, an effect similar to that obtained when rollers 163 are used as described above can be achieved; in this case, however, since the system is a non-contact type system utilizing the repulsive force of magnets 263 and 264, the durability of the system is superior to that of a system using rollers, so that maintenance costs can be reduced.

Furthermore, in this second embodiment as in the first embodiment, the cylinder type actuators 260 may be formed as air pressure cylinders in which the pistons 262 are raised and lowered by supplying air pressure to the interiors of the cylinders 261; however, in order to improve the response, these actuators may also be formed as electromagnetic actuators in which magnets and coils are combined inside the cylinders 261 and the pistons are raised and lowered by means of an electromagnetic force.

In the present CMP apparatus 1, as was described earlier, the apparatus is arranged so that the polishing member 40 is maintained in a fixed attitude relative to the surface of the wafer by applying a corrective moment to the polishing member 40 during the polishing of the wafer W. Accordingly, even in cases where the polishing surface (i.e., the polishing pad 43) protrudes beyond the outer circumference of the wafer W, there is no tilting of the polishing member 40 at the outer circumferential edge of the wafer W, so that there is no sloping (beveling) of the peripheral portions of the wafer W. As a result, the rate of production of satisfactory wafers is increased, so that manufacturing costs can be reduced.

Figure 9:
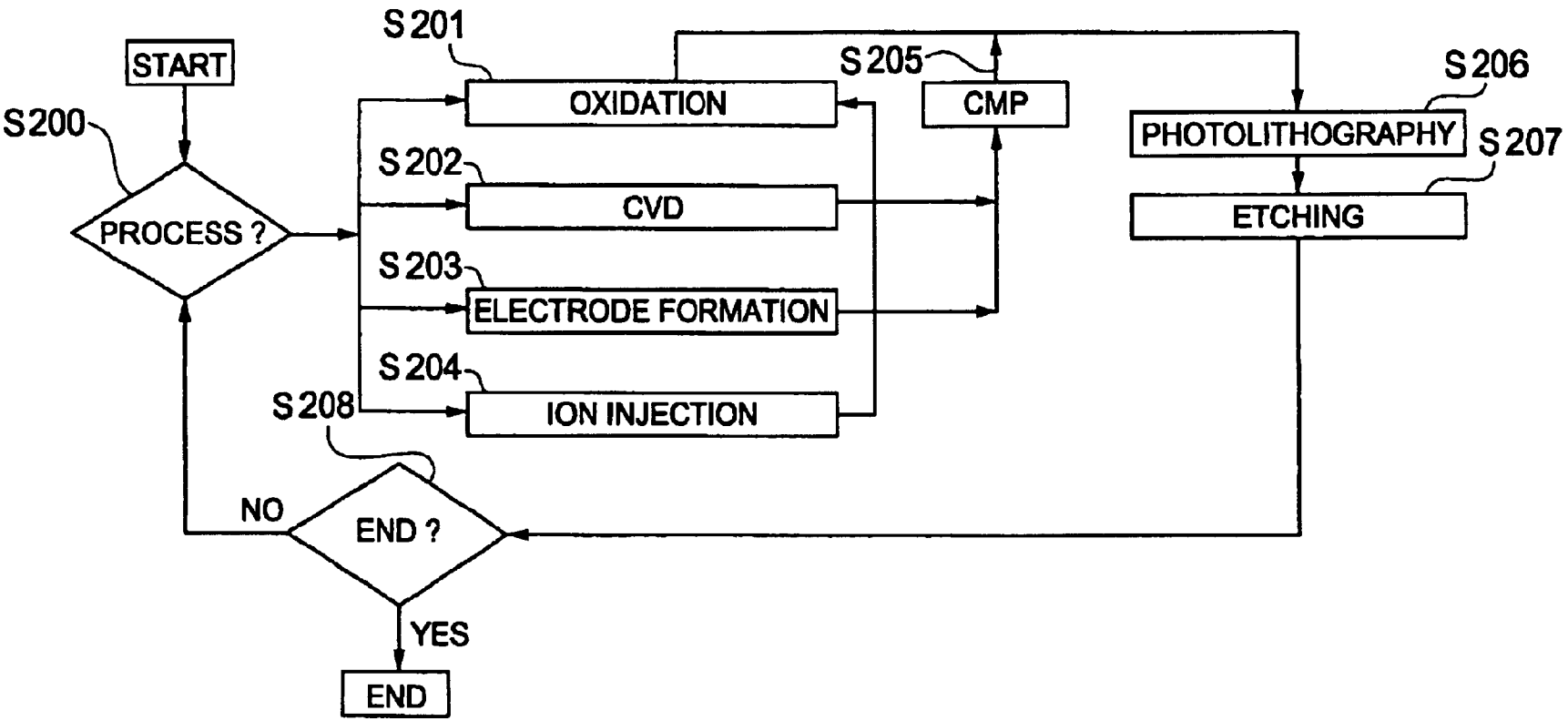
FIG. 9 is a flow chart which illustrates the semiconductor device manufacturing method of the present invention.

Next, one example of the semiconductor device manufacturing method of the present invention will be described. FIG. 9 is a flow chart which shows the semiconductor device manufacturing process. When the semiconductor manufacturing process is started, the appropriate working processes are first selected in step S200 from the steps S201 through S204 described below, and the work proceeds to one of these steps.

Here, step S201 is an oxidation process in which the surface of the wafer is oxidized. Step S202 is a CVD process in which an insulating film or dielectric film is formed on the surface of the wafer by CVD, etc. Step S203 is an electrode formation process in which electrodes are formed on the wafer by vacuum evaporation, etc. Step S204 is an ion injection process in which ions are injected into the wafer.

Following the CVD process (S202) or the electrode formation process (S203), the work proceeds to step S205. Step S205 is a CMP process. In this CMP process, the smoothing of inter-layer insulation films or the formation of a damascene by the polishing of metal films or the polishing of dielectric films on the surfaces of semiconductor devices, etc., is performed using the polishing apparatus of the present invention (i.e., the above-mentioned CMP apparatus 1).

Following the CMP process (S205) or oxidation process (S201), the work proceeds to step S206. Step S206 is a photolithographic process. In this process, the wafer is coated with a resist, a circuit pattern is burned onto the wafer by exposure using an exposure apparatus, and the exposed wafer is developed. Furthermore, the next step S207 is an etching process in which the portions other than the developed resist image are removed by etching, and the resist is then stripped away so that the resist that is unnecessary when etching is completed is removed.

Next, in step S208, a judgement is made as to whether or not all of the necessary processes have been completed; if these processes have not been completed, the work returns to step S200, and the previous steps are repeated so that a circuit pattern is formed on the wafer. If it is judged in step S208 that all of the processes have been completed, the work is ended.

Since the polishing apparatus of the present invention (i.e., the CMP apparatus 1) is used in the CMP process in the semiconductor device manufacturing method of the present invention, the yield of the semiconductor device that are manufactured can be increased. As a result, semiconductor devices can be manufactured at a lower cost than in conventional semiconductor device manufacturing methods. Furthermore, the polishing apparatus of the present invention can also be used in the CMP processes of semiconductor device manufacturing processes other than the above-mentioned semiconductor device manufacturing process.

Furthermore, since wafers (substrates) with a high degree of smoothness are used in the semiconductor devices (e.g., transistors or memories, etc.) manufactured by the above-mentioned semiconductor device manufacturing method, devices with good performance in which there are few problems such as faulty insulation or short-circuiting of wiring, etc., can be obtained.

Furthermore, the attitude-maintaining means 50 in the present CMP apparatus 1 is equipped with an electromagnetic actuator that generates an electromagnetic force in accordance with the current supplied, and is arranged so that a corrective moment can thus be applied to the polishing member. Accordingly, the apparatus of the present invention has a quick response, so that the attitude of the polishing member 40 can be quickly adjusted. In particular, if an electromagnetic actuator of the above-mentioned type which applies a corrective moment to the polishing member 40 by generating a Lorenz force between a current and a magnetic field is used, the attitude of the polishing member 40 can be corrected with a good response using a simple construction.

Preferred embodiments of the present invention has been described so far; however, the scope of the present invention is not limited to the embodiments described above. For example, in the embodiments, the number of coils 58 held on the coil holding frame 57 was four. However, the present invention is not limited to four coils; it would also be possible to install more or fewer coils, and it would likewise be possible to install only two coils in facing positions. As was described above, however, it is always necessary to install the coils in positions that suppress tilting of the polishing member 40.

Furthermore, in the embodiments, a CMP apparatus in which polishing of the wafer was performed while a liquid-form slurry (polishing liquid) containing silica particles was supplied was described as an example. However, it is not absolutely necessary that the wafer manufacturing apparatus of the present invention have a device that supplied such a slurry.

In the polishing apparatus of the present invention, as was described above, there is no tilting of the polishing member at the outer circumferential edge of the substrate, and therefore no sloping (beveling) of the peripheral portions of the substrate, even in cases where the polishing surface protrudes beyond the outer circumference of the substrate. Accordingly, the rate of production of satisfactory substrates is increased, so that manufacturing costs can be reduced.

Here, if the attitude-maintaining means is arranged so that a corrective moment is applied to the polishing member in accordance with the position of the polishing member relative to the rotating table, the construction of the control system can be simplified. Furthermore, if a sensor that detects the distribution of the contact pressure between the polishing surface and the surface of the substrate or the inclination of the polishing surface relative to the surface of the substrate is installed, and the apparatus is arranged so that a corrective moment is applied to the polishing member on the basis of detection information from this sensor, tilting of the polishing member can be reliably prevented.

Furthermore, if the attitude-maintaining means is equipped with an electromagnetic actuator that generates an electromagnetic force in accordance with the current supplied, and is arranged so that a corrective moment is applied to the polishing member using the electromagnetic force generated by this electromagnetic actuator, the response can be accelerated so that adjustment of the attitude of the polishing member can be quickly accomplished.

Furthermore, if the electromagnetic actuator is equipped with an annular permanent magnet which is supported on the outer circumferential portion of the polishing member and whose magnetic field is oriented in the radial direction of the polishing member, and a plurality of coils which are supported on a non-rotating member and disposed in the form of a circle that is substantially concentric with the permanent magnet, and which have portions that cross the magnetic field at right angles, and the apparatus is arranged so that a corrective moment is applied to the polishing member by applying a current to the coils facing portions in which the polishing member floats upward or is pushed downward from the surface of the substrate so that a Lorenz force is generated between the magnetic filed and the current flowing through the horizontal portions of these coils, the attitude of the polishing member can be corrected with a good response by means of a simple construction.

Furthermore, it is desirable that the apparatus be arranged so that the polishing member is pressed against the substrate as a result of receiving the electromagnetic force generated by the electromagnetic actuator, and so that the contact pressure between the polishing surface and the surface of the substrate can be maintained at a constant value by adjusting the current that is supplied to the electromagnetic actuator. Alternatively, it would also be possible to arrange the apparatus so that the polishing member is pressed against the substrate as a result of receiving air pressure and the electromagnetic force generated by the electromagnetic actuator, and so that the contact pressure between the polishing surface and the surface of the substrate can be maintained at a constant value by adjusting the air pressure and the current that is supplied to the electromagnetic actuator. If such an embodiment is used, the control that always maintains the contact pressure between the polishing surface and the surface of the substrate at a constant value (especially in cases where the polishing surface protrudes beyond the outer circumference of the substrate so that the contact area between the two parts varies) can be accomplished with a better response than in the case of a conventional construction in which the polishing member is pressed against the substrate by means of air pressure (alone); accordingly, the uniformity of the polishing on the surface of the wafer can be increased.

Alternatively, the adjustment of the contact pressure between the polishing surface and the surface of the substrate can also be accomplished using a construction in which the polishing member is pressed against the substrate as a result of receiving the electromagnetic force generated by a shaft motor, and the apparatus is arranged so that the contact pressure between the polishing surface and the surface of the substrate can be adjusted by means of the current that is supplied to this shaft motor.

Furthermore, an embodiment may also be used in which an attitude-maintaining means is equipped with a plurality of cylinder type actuators which are fastened to a non-rotating member, and in which pistons that have rollers attached to their lower end portions move upward and downward inside cylinders that extend in the vertical direction, the plurality of cylinder type actuators are positioned so that they surround the periphery of the polishing member, the rollers contact the outer circumferential portion of the polishing member from above, and a corrective moment is applied to the polishing member as a result of the pistons of the cylinder type actuators positioned in areas where the polishing member tends to float upward from the substrate surface being lowered so that the polishing member is pushed downward. Sloping (beveling) of the peripheral portions of the substrate can also be prevented by means of such a construction.

Furthermore, an embodiment may be used in which an attitude-maintaining means is equipped with a plurality of cylinder type actuators which are fastened to a non-rotating member, and in which pistons that have first permanent magnets attached to their lower end portions move upward and downward inside cylinders that extend in the vertical direction, an annular second permanent magnet which is installed so that it faces all of the first permanent magnets is disposed on the outer circumferential portion of the polishing member, the plurality of cylinder type actuators are positioned so that they surround the periphery of the polishing member, the facing surfaces of the respective permanent magnets have the same polarity, and the corrective moment is applied to the polishing member as a result of the pistons of the cylinder type actuators positioned in areas where the polishing member tends to float upward from the substrate surface being lowered so that the polishing member is pushed downward. If such an embodiment is used, the durability of the apparatus can be further improved, so that maintenance costs can be reduced. Here, the above-mentioned cylinder type actuators may also be actuators that are operated by air pressure; however, in order to achieve a quicker response, it is desirable that these actuators be actuators that are operated by an electromagnetic force.

Furthermore, in the semiconductor device manufacturing method of the present invention, since the polishing apparatus is used in the substrate polishing process, the yield of the manufactured semiconductor devices can be increased. Moreover, since substrates with a high degree of smoothness are used in the semiconductor devices of the present invention manufactured by the semiconductor device manufacturing method, these devices show good performance with few problems such as faulty insulation or short-circuiting of the wiring, etc.

What is claimed is:

1. A polishing apparatus comprising:

a rotating table that separately holds a substrate to be polished;

a polishing member having a polishing surface which is pressed against a surface of the substrate to be polished, wherein the polishing member rotates about an axis substantially parallel to an axis of rotation of the rotating table, and the polishing member oscillates in a direction parallel to the surface of the substrate to polish the substrate; and an attitude-maintaining means for maintaining the surface of the polishing member in a parallel fixed attitude with respect to the surface of the substrate by applying a corrective moment to the polishing member during polishing.

2. The polishing apparatus of claim 1, wherein the attitude-maintaining means applies the corrective moment to the polishing member according to a position of the polishing member relative to the rotating table.

3. The polishing apparatus of claim 1, wherein the attitude-maintaining means comprises a sensor that detects one of a distribution of contact pressure between the polishing surface and the surface of the substrate, and an inclination of the polishing surface relative to the surface of the substrate, and applies the corrective moment to the polishing member based upon detection information from the sensor.

4. The polishing apparatus of any of claims 1 through 3, wherein the attitude-maintaining means comprises an electromagnetic actuator for generating an electromagnetic force corresponding to a supplied current, and applies the corrective moment to the polishing member using the electromagnetic force generated by the electromagnetic actuator.

5. The polishing apparatus claimed of claim 4, wherein the electromagnetic actuator comprises:

an annular permanent magnet supported on an outer circumferential part of the polishing member, wherein a magnetic field is oriented in a direction of a radius of the polishing member; and a plurality of coils supported on a non-rotating member which are disposed in the form of a circle substantially concentric with the annular permanent magnet, and have portions that cross the magnetic field at right angles, wherein the electromagnetic actuator applies the corrective moment to the polishing member using the Lorenz force that is generated between the magnetic field and the current that flows through the portions of the coils facing a part of the polishing member that floats upward from the substrate surface or is pushed downward against the substrate surface, as a result of the coils being electrified.

6. The polishing apparatus of claim 4, wherein the polishing member is pressed against the substrate by receiving the electromagnetic force generated by the electromagnetic actuator, wherein the contact pressure between the polishing surface and the substrate surface is maintained at a constant value by adjusting the supplied current to the electromagnetic actuator.

7. The polishing apparatus of claim 5, wherein the polishing member is pressed against the substrate by receiving the electromagnetic force generated by the electromagnetic actuator, wherein the contact pressure between the polishing surface and the substrate surface is maintained at a constant value by adjusting the supplied current to the electromagnetic actuator.

8. The polishing apparatus claimed of claim 4, wherein the polishing member is pressed against the substrate by receiving air pressure and the electromagnetic force generated by the electromagnetic actuator, wherein the contact pressure between the polishing surface and the substrate surface is maintained at a constant value by adjusting the air pressure and the supplied current to the electromagnetic actuator.

9. The polishing apparatus claimed of claim 5, wherein the polishing member is pressed against the substrate by receiving air pressure and the electromagnetic force generated by the electromagnetic actuator, wherein the contact pressure between the polishing surface and the substrate surface is maintained at a constant value by adjusting the air pressure and the supplied current to the electromagnetic actuator.

10. The polishing apparatus of claim 4, wherein the polishing member is pressed against the substrate by receiving the electromagnetic force generated by a shaft motor, wherein the contact pressure between the polishing surface and the substrate surface is adjusted by means of a supplied current to the shaft motor.

11. The polishing apparatus of claim 5, wherein the polishing member is pressed against the substrate by receiving the electromagnetic force generated by a shaft motor, wherein the contact pressure between the polishing surface and the substrate surface is adjusted by means of a supplied current to the shaft motor.

12. The polishing apparatus of any of claims 1 through 3, wherein the attitude-maintaining means comprises:

a plurality of cylinder type actuators, each fastened to a non-rotating member, comprising pistons comprising rollers attached to lower end portions of the pistons which move upward and downward inside cylinders extending in a vertical direction, wherein the plurality of cylinder type actuators surround a periphery of the polishing member, the rollers contact an outer circumferential portion of the polishing member from above, the corrective moment is applied to the polishing member as a result of the pistons of the cylinder type actuators positioned in areas where the polishing member floats upward from the substrate surface being lowered so that the polishing member is pushed downward.

13. The polishing apparatus claimed in any of claims 1 through 3, wherein the attitude-maintaining means comprises:

a plurality of cylinder type actuators fastened to a non-rotating member in which pistons having first permanent magnets attached to lower end portions of the pistons which move upward and downward inside cylinders extending in a vertical direction; and an annular second permanent magnet, facing the first permanent magnets, disposed on an outer circumferential portion of the polishing member, wherein the plurality of cylinder type actuators surround a periphery of the polishing member, facing surfaces of the respective first and second permanent magnets have a same polarity, and the corrective moment is applied to the polishing member as a result of the pistons of the cylinder type actuators positioned in areas where the polishing member floats upward from the substrate surface being lowered so that the polishing member is pushed downward.

14. The polishing apparatus of claim 12, wherein the cylinder type actuators are operated by means of air or electromagnetic force.

15. The polishing apparatus of claim 13, wherein the cylinder type actuators are operated by means of air or electromagnetic force.

16. A semiconductor device manufacturing method including a process in which a surface of a substrate is polished using the polishing apparatus of any of claims 1 through 3.

17. A semiconductor device manufacturing method including a process in which a surface of a substrate is polished using the polishing apparatus of claim 4.

18. A semiconductor device manufacturing method including a process in which a surface of a substrate is polished using the polishing apparatus of any one of claims 5 through 11.

19. A semiconductor device manufacturing method including a process in which a surface of a substrate is polished using the polishing apparatus of claim 12.

20. A semiconductor device manufacturing method including a process in which a surface of a substrate is polished using the polishing apparatus of claim 13.

21. A semiconductor device manufacturing method including a process in which a surface of a substrate is polished using the polishing apparatus of claim 14.

22. A semiconductor device manufactured by the semiconductor device manufacturing method of claim 16.

23. A semiconductor device manufactured by the semiconductor device manufacturing method of claim 17.

24. A semiconductor device manufactured by the semiconductor device manufacturing method of claim 18.

25. A semiconductor device manufactured by the semiconductor device manufacturing method of claim 19.

26. A semiconductor device manufactured by the semiconductor device manufacturing method of claim 20.

27. A semiconductor device manufactured by the semiconductor device manufacturing method of claim 21.

28. A semiconductor device manufacturing method including a process in which a surface of a substrate is polished using the polishing apparatus of claim 15.

29. The polishing apparatus of claim 1, wherein a contact area between the polishing surface and the substrate varies during polishing.

30. The polishing apparatus of claim 29, wherein the attitude-maintaining means applies the corrective moment to the polishing member according to a position of the polishing member relative to the rotating table.

31. The polishing apparatus of claim 29, wherein the attitude-maintaining means comprises an electromagnetic actuator for generating an electromagnetic force corresponding to a supplied current, and applies the corrective moment to the polishing member using the electromagnetic force generated by the electromagnetic actuator.

32. The polishing apparatus claimed of claim 31, wherein the electromagnetic actuator comprises:

an annular permanent magnet supported on an outer circumferential part of the polishing member, wherein a magnetic field is oriented in a direction of a radius of the polishing member; and a plurality of coils supported on a non-rotating member which are disposed in the form of a circle substantially concentric with the annular permanent magnet, and have portions that cross the magnetic field at right angles, wherein the electromagnetic actuator applies the corrective moment to the polishing member using the Lorenz force that is generated between the magnetic field and the currrnt that flows through the portions of the coils facing a part of the polishing member that floats upward from the substrate surface or is pushed downward against the substrate surface, as a result of the coils being electrified.

33. A semiconductor device manufacturing method including a process in which a surface of a substrate is polished using the polishing apparatus of claim 28.

34. A polishing apparatus comprising:

a rotating table that separately holds a substrate to be polished;

a polishing member having a polishing surface which is pressed against a surface of the substrate to be polished, wherein the polishing member rotates about an axis substantially parallel to an axis of rotation of the rotating table, and the polishing member oscillates in a direction parallel to the surface of the substrate to polish the substrate; and at least one actuator for generating a force to move upward the polishing member during polishing, wherein the polishing member is disposed over the rotating table.

35. The polishing apparatus of claim 34, wherein the actuator is an electromagnetic actuator.

36. A semiconductor device manufacturing method including a process in which a surface of a substrate is polished using the polishing apparatus of claim 34.

37. A polishing apparatus comprising:

a rotating table that separately holds a substrate to be polished;

a polishing member having a polishing surface which is pressed against a surface of the substrate to be polished, wherein the polishing member rotates about an axis substantially parallel to an axis of rotation of the rotating table, and the polishing member oscillates in a direction parallel to the surface of the substrate to polish the substrate; and a plurality of actuators generating force to tilt the polishing member during polishing.

38. The polishing apparatus of claim 37, wherein the actuators are electromagnetic actuators.

39. A semiconductor device manufacturing method including a process in which a surface of a substrate is polished using the polishing apparatus of claim 37.

* * * * *